US006693378B1

(12) United States Patent
Shon

(10) Patent No.: US 6,693,378 B1
(45) Date of Patent: Feb. 17, 2004

(54) MAGNETRON FOR MICROWAVE OVENS

(75) Inventor: Jong-Chull Shon, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/306,856

(22) Filed: Nov. 29, 2002

(30) Foreign Application Priority Data

Aug. 5, 2002 (KR) ..... 2002-46167

(51) Int. Cl.[7] ..... H01J 25/50
(52) U.S. Cl. ..... 315/39.51; 315/39.63
(58) Field of Search ..... 315/39.51, 39.63, 315/39.67, 39.71, 39.75

(56) References Cited

U.S. PATENT DOCUMENTS 4,743,805 A * 5/1988 Takada ..... 315/39.75
4,891,557 A * 1/1990 Nobue et al. ..... 315/39.51
5,146,136 A * 9/1992 Ogura et al. ..... 315/39.69

FOREIGN PATENT DOCUMENTS

| | | |
|---|---|---|
| KR | 1996-0009129 | 7/1996 |
| KR | 10-0188605 | 1/1999 |
| KR | 20-0152142 | 4/1999 |

* cited by examiner

*Primary Examiner*—Don Wong
*Assistant Examiner*—Thuy Vinh Tran
(74) *Attorney, Agent, or Firm*—Staas & Halsey LLP

(57) ABSTRACT

A magnetron for microwave ovens includes a positive polar cylinder, a cathode, and a plurality of vanes. The vanes constitute a positive polar section along with the positive polar cylinder. Each of the vanes is provided with a first depression to allow a large-diameter strip ring to be disposed therein, and a second depression to allow a small-diameter strip ring to be disposed therein. Each vane is provided at a cathode-side corner of the first depression with a thermion travel passage to allow thermions to smoothly flow without the hindrance of the first depression.

13 Claims, 6 Drawing Sheets

MAGNETRON FOR MICROWAVE OVENS

CROSS-REFERENCE TO RELATED APPLICATION

This application claims the benefit of Korea Application No. 2002-46167, filed Aug. 5, 2002, in the Korean Intellectual Property Office, the disclosure of which is incorporated herein by reference.

BACKGROUND OF THE INVENTION

1. Field of the Invention

The present invention relates generally to a magnetron for microwave ovens, and more particularly, to a vane of a magnetron for microwave ovens.

2. Description of the Related Art

Generally, a magnetron is constructed to have an anode and a cathode such that thermions are discharged from the cathode and spirally moved to the anode by electromagnetic force. A spinning electron pole is generated around the cathode by the thermions and current is induced in an oscillation circuit of the anode, so that oscillation is continuously stimulated. An oscillation frequency of the magnetron is generally determined by the oscillation circuit, and has high efficiency and high output power. The magnetron is widely used in home appliances, such as microwave ovens, as well as in industrial applications, such as high-frequency heating apparatuses, particle accelerators and radar systems.

The general construction and operation of the above-described magnetron are briefly described with reference to FIGS. 1 through 3.

As shown in FIG. 1, the magnetron generally includes a positive polar cylinder 101 made of an oxygen free copper pipe or the like, a plurality of vanes 102 disposed in the positive polar cylinder 101 to constitute a positive polar section along with the positive polar cylinder 101 and radially arranged at regular intervals to form a cavity resonator, and an antenna 103 connected to one of the vanes 102 to induce harmonics to an outside. The magnetron also includes a large-diameter strip ring 104 and a small-diameter strip ring 105 disposed on upper and lower portions of the vanes 102, respectively, to alternately and electrically connect the vanes 102 so that the vanes 102 alternately have the same electric potential as shown in FIG. 2.

Rectangular depressions 202 are formed in the vanes 102, respectively, to allow the strip rings 104 and 105 to alternately and electrically connect the vanes 102, and cause each opposite pair of the vanes 102 to be disposed in an inverted manner. According to the above-described construction, each of the pair of opposite vanes 102 and the positive polar cylinder 101 constitute a certain LC resonant circuit. Additionally, a filament 106 in a form of a coil spring is disposed in an axial center portion of the positive polar cylinder 101, and an activating space 107 is provided between radially inside ends of the vanes 102 and the filament 106. An upper shield 108 and a lower shield 109 are attached to a top and bottom of the filament 106, respectively. A center lead 110 is welded to a bottom of the upper shield 108 while being passed through a through hole of the lower shield 109 and the filament 106. A side lead 111 is welded to a bottom of the lower shield 109. The center lead 110 and the side lead 111 are connected to terminals of an external power source (not shown), and therefore, forms a closed circuit in the magnetron.

An upper permanent magnet 112 and a lower permanent magnet 113 are provided to apply a magnetic field to the activating space 107 with opposite magnetic poles of the upper and lower permanent magnets 112 and 113 facing each other. An upper pole piece 117 and a lower pole piece 118 are provided to induce rotating magnetic flux generated by the permanent magnets 112 and 113 into the activating space 107. The above-described elements are enclosed in an upper yoke 114 and a lower yoke 115. Cooling fins 116 connect the positive polar cylinder 101 to the lower yoke 115, and radiate heat generated in the positive polar cylinder 101 to the outside through the lower yoke 115.

According to the above-described construction of the magnetron, when power is applied to the filament 106 from the external power source, the filament 106 is heated by operational current supplied to the filament 106, the thermions are emitted from the filament 106, and a group of thermions 301 are produced in the activating space 107 by the emitted thermions as shown in FIG. 3. The group of thermions 301 alternately imparts potential difference to each neighboring pair of the vanes 102 while being in contact with front ends of the vanes 102, being rotated by influence of the magnetic field formed in the activating space 107, and being moved from one state "i" to another state "i". Accordingly, harmonics corresponding to a rotation speed of the thermion group 301 are generated by oscillation of the LC resonant circuit formed by the vanes 102 and the positive polar cylinder 101, and transmitted to the outside through the antenna 103.

Generally, frequency is calculated by an equation $$f=1/2\pi\sqrt{LC},$$

where L is an inductance and C is a capacitance. Values of the variables of the above equation are determined by geometrical configurations of circuit elements. Thus, the configurations of the vanes 102 constituting part of the LC resonant circuit are principal factors in determining the frequency of harmonics.

In the magnetron having the above-described construction and operation, noise of a considerably wide band considered as unwanted electromagnetic waves is generated. The noise may induce malfunction in other devices. Thus, a reduction in the noise is an important technical issue that has been researched for a long time. In this regard, the geometrical configuration of the vane, which is one of factors that determine a frequency of electromagnetic waves generated in the magnetron, is an important technical issue relative to the generation of noise.

Conventional vanes constituting parts of the magnetron are constructed as shown in FIG. 4. The shortcomings of the conventional vanes are described with reference to FIG. 4. As shown in FIG. 4, a pair of neighboring vanes is illustrated as being opposite to each other for convenience of explanation.

As shown in FIG. 3, the depressions 202 are formed to allow the strip rings to be disposed therein. In FIG. 4, the depressions 202 are constructed to have rectangular shapes. After the thermions arrive at sections "a," "b" and "c" of the front side of a vane 102, the thermions arriving at the section "a" are moved to the section "c" of the front side of another neighboring vane 102 because of the inverted relationship of the pair of neighboring vanes 202. As the thermions arrive at the front side of the vane 102, a potential difference is generated between the pair of neighboring vanes 102 and, current (that is, the flow of thermions) is supplied to the filament 106. The thermions arriving at the sections "a" and "c" are moved to the sections "c" and "a" of the front side of the neighboring vane 102 along roundabout paths due to a hindrance effect of the depressions 202, thus resulting in delaying the arrival of the thermions at the section "b" of the front side of the neighboring vane 102 in comparison with the arrival of the sections "a" and "c".

In FIG. 4, arrows L1, L2 and L3 represent distances along which the thermions travel from one of the vanes 102 to the neighboring vane 102. The thermions at the sections "a" and "c" travel along the same distance at the same time. A main frequency of the magnetron is generally determined by the sections "b" of the vanes 102. Therefore, the delays in the thermions reaching the sections "a" and "b" of the neighboring vane 102 cause noise in all the frequencies of the magnetron.

SUMMARY OF THE INVENTION

Accordingly, it is an aspect of the present invention to provide a magnetron for microwave ovens to reduce high frequency noise caused by a difference between velocities of thermions flowing through vanes of the magnetron, thus optimizing frequency of microwaves emitted from the magnetron.

Additional aspects and advantages of the invention will be set forth in part in the description which follows and, in part, will be obvious from the description, or may be learned by practice of the invention.

The foregoing and other aspects of the present invention are achieved by providing a magnetron for microwave ovens, including a positive polar cylinder, a cathode, and a plurality of vanes to constitute a positive polar section along with the positive polar cylinder. Each of the vanes is provided with a first depression to allow a large-diameter strip ring to be disposed therein, and a second depression to allow a small-diameter strip ring to be disposed therein. Also, the vane is provided at a cathode-side corner of the first depression with a thermion travel passage to allow thermions to smoothly flow without hindrance of the first depression.

BRIEF DESCRIPTION OF THE DRAWINGS

The above and other aspects and advantages of the invention will become apparent and more appreciated from the following description of the preferred embodiments, taken in conjunction with the accompanying drawings of which.

DESCRIPTION OF THE PREFERRED EMBODIMENTS

Figure 1:
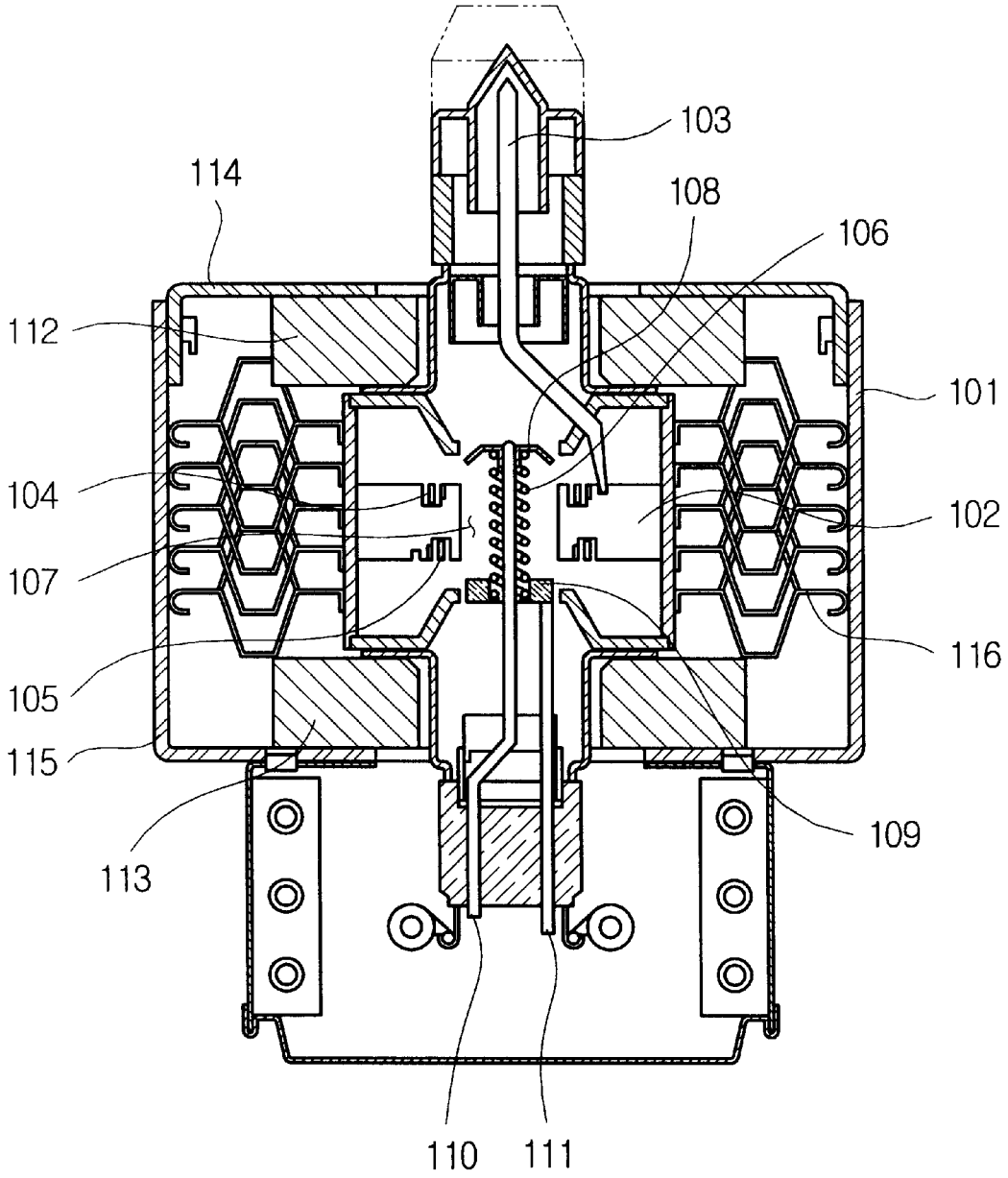
FIG. 1 (Prior Art)
FIG. 1 is a longitudinal section of a conventional magnetron for microwave ovens.
Figure 2:
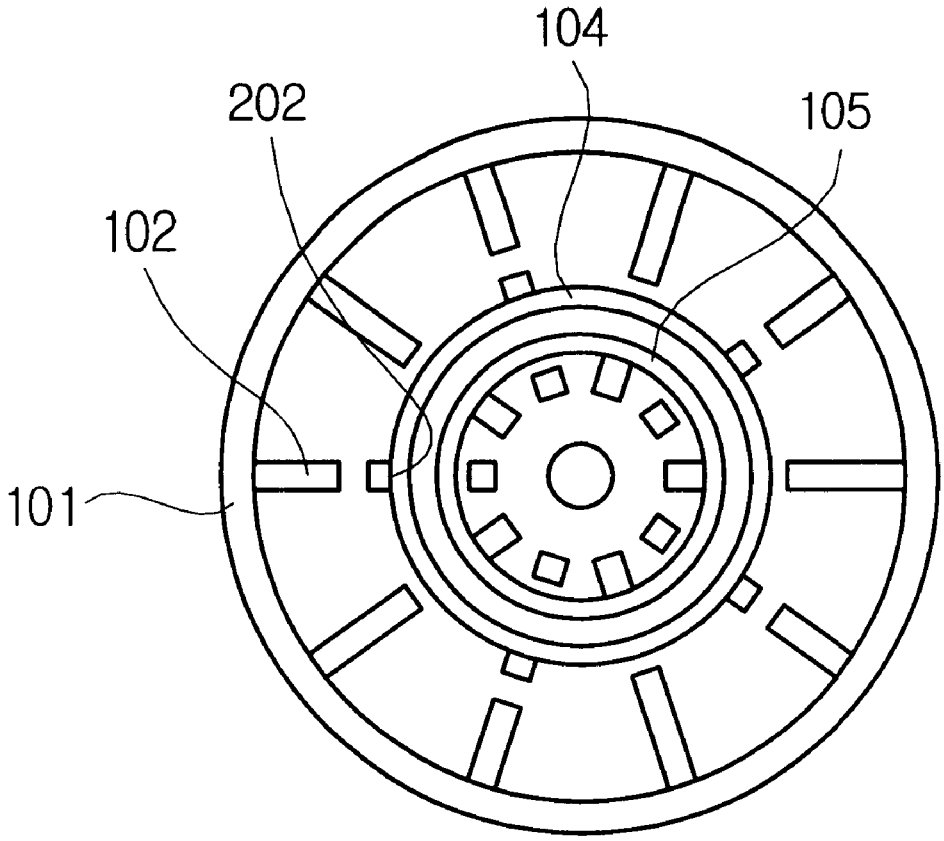
FIG. 2 (Prior Art)
FIG. 2 is a cross section of a polar section of FIG. 1.

Reference will now be made in detail to the present preferred embodiments of the present invention, examples of which are illustrated in the accompanying drawings, wherein like reference numerals refer to like elements throughout.

First, as described in conjunction with the prior art, when an external power source is applied to a magnetron, heat is continuously generated in a filament composed of a mixture of tungsten and thorium oxide. Thermions excited by the heat deviate from a potential well and escape from the filament. Since the thermions are emitted from the filament through an entire surface of the filament, a group of thermions exist in an activating space formed between the filament and vanes. The group of thermions are moved toward the vanes by an action of an electric field produced between the filament and the vanes. A resultant force $F=-e(E+\upsilon B)$ made of a horizontal force and vertical force is formed by a magnetic force that is produced in the activating space by permanent magnets disposed in upper and lower portions of the magnetron under influence of movement of the thermions. In the above equation, F is a resultant force, $-e$ is a quantity of electric charge, E is an intensity of an electric field between a filament and vanes, $\upsilon$ is a velocity of thermions, and B is an intensity of a magnetic field produced by permanent magnets. Additionally, since groups of thermions are continuously emitted from the filament, there occurs a phenomenon in which the groups of thermions are continuously moved to the vanes.

Figure 5:
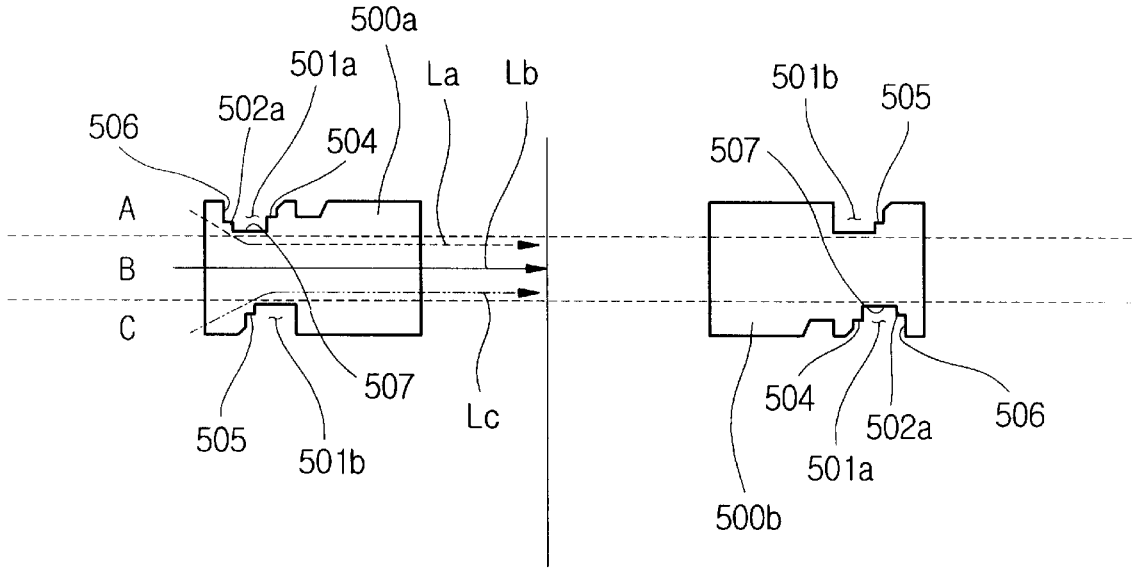
FIG. 5 is a side view showing vanes and a flow of thermions therethrough, according to an embodiment of the present invention.

Based on the description of the construction and operation of a conventional magnetron, a pair of neighboring vanes 500*a* and 500*b*, according to an embodiment of the present invention is described with reference to FIG. 5. In FIG. 5, the pair of neighboring vanes 500*a* and 500*b* is illustrated as being opposite to each other for convenience of explanation.

As shown in FIG. 5, the vane 500*a* is in a geometrically symmetric relationship with the vane 500*b* in that they are not symmetrical on a plane but are symmetrical in an inverted relationship.

A rectangular protrusion 502*a* is formed to partially connect a cathode side 506 and bottom 507 of the depression 501*a* to each other at a corner of the cathode side 506 of the depression 501*a*, so that the depression 501*a* has a stepped shape. A rectangular protrusion 504 constructed similarly to the rectangular protrusion 502*a*, and formed at the corner of the depression 501*a* opposite to the corner at which the rectangular protrusion 502*a* is formed, and another rectangular protrusion 505 constructed similarly to the rectangular protrusion 502*a* and formed at a corner of a cathode side of a depression 501*b*, each have an object of alternately connecting strip rings to the vanes 500*a* and 500*b*.

The operation of the vane of the magnetron according to the present invention is described below.

Figure 3:
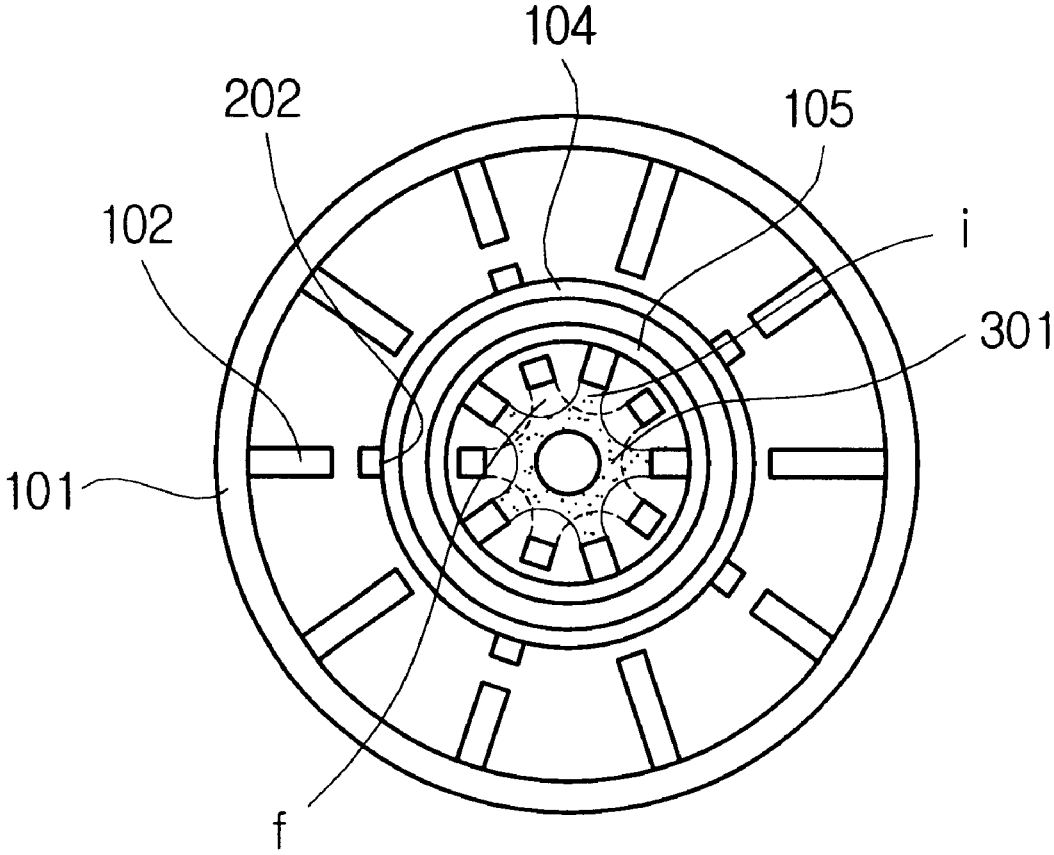
FIG. 3 (Prior Art)
FIG. 3 is a cross section showing a formation of thermions of the polar section shown in FIG. 2.
Figure 4:
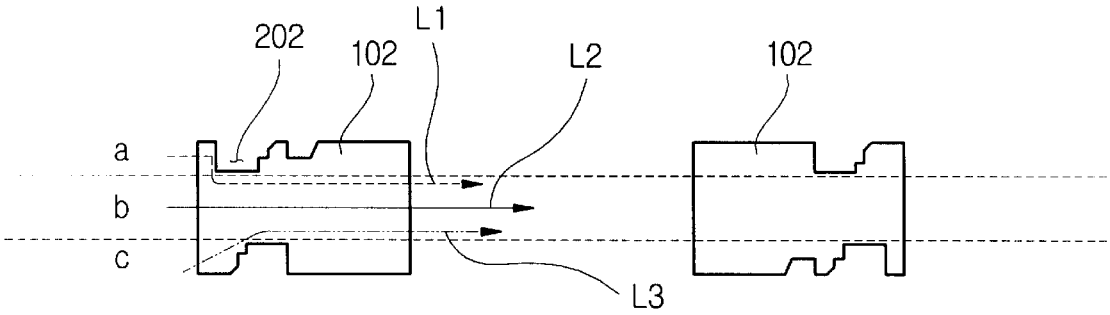
FIG. 4 (Prior Art)
FIG. 4 is a side view showing conventional vanes and a flow of thermions therethrough.

A group of thermions, which is formed in an activating space as shown in FIG. 3, causes the pair of neighboring vanes 500*a* and 500*b* to have an electric phase difference of 180° therebetween in $\pi$-mode. Accordingly, when the thermions arrive at a front of a random vane, for example, 500*a*, an electric phase difference of 180° (that is, a certain potential difference) is generated between the vane 500*a* and another vane, for example, 500*b*, opposite vane 500*a*, thus inducing a flow of current due to a movement of the thermions).

For convenience of explanation, there is described a case where thermions arrive at the front side of the vane 500*a* with the front side divided into sections "A," "B" and "C". The thermions departing from the front side of the vane 500*a* are moved toward the front side of the vane 500*b*. A velocity of the thermions is closely related to a frequency of microwaves emitted to an outside. In the present invention, the movement of thermions does not require a roundabout path because the thermions are moved almost straight to the neighboring vane 500*b* through the rectangular protrusion 502*a* without hindrance of the depression 501*a* formed on the vane 500*a*. Thus, the rectangular depression 501*a* provides the thermions with an almost straight travel path, and the rectangular protrusion 502*a* functions as a thermion travel passage to allow the thermions arriving at the section "A" to be smoothly moved to the neighboring vane 500*b*.

Accordingly, differences between distances ("La," "Lb," and "Lc"), along which the thermions travel to sections "A," "B" and "C", per time, (that is, differences between the velocities of thermions) are significantly reduced or eliminated. The fact that the differences between the velocities of the thermions are significantly reduced or eliminated means that parasitic frequencies included in a main frequency are reduced or eliminated. In turn, this also means that an occurrence of noise in a high frequency is reduced and thus, efficiency of the magnetron is improved.

As a result, the rectangular protrusion 502*a* is formed at the corner of the cathode side of the depression 501*a* to keep thermions from taking a roundabout path. Consequently, the thermions arriving at the section "A" are allowed to have a velocity identical with or similar to that of the thermions arriving at the section "B", so the same frequency is generated in a resonant circuit composed of the vanes 500*a* and 500*b* and a positive polar cylinder, thus improving quality of the magnetron.

Figure 6A:
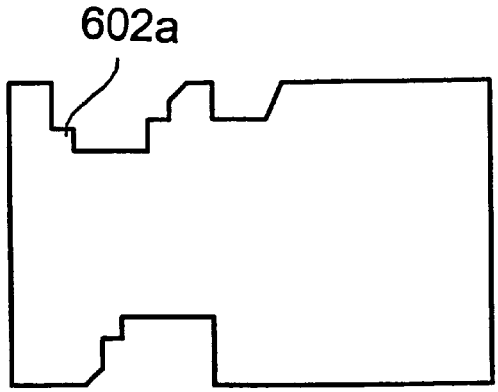
FIGS. 6A through 6D are diagrams of a variety of vanes, according to various embodiments of the present invention.
Figure 6B:
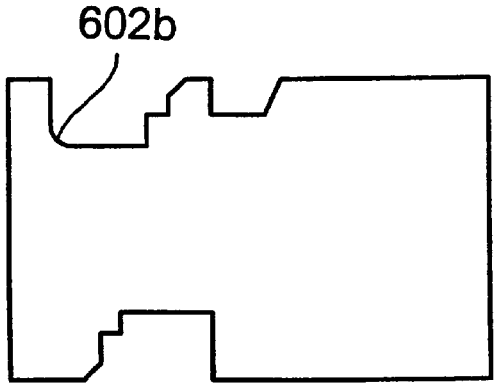
Figure 6C:
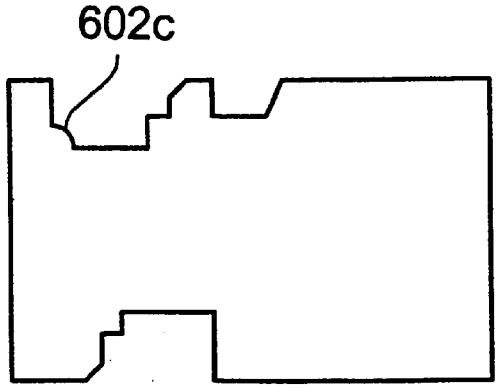
Figure 6D:
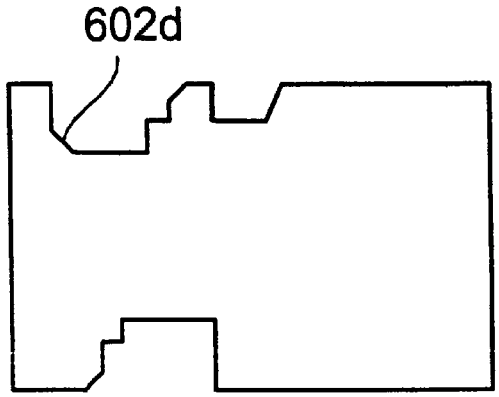

FIGS. 6A through 6D are diagrams of a variety of vanes, according to various embodiments of the present invention. In FIG. 6A, a vane is provided with a rectangular protrusion 602*a* at a cathode-side corner of its upper depression. In FIG. 6B, a vane is provided with a right-triangular protrusion 602*b* having a concave hypotenuse at the cathode-side corner of its upper depression. In FIG. 6C, a vane is provided with a quarter-circular protrusion 602*c* at the cathode-side corner of its upper depression. In FIG. 6D, a vane is provided with a right-triangular protrusion 602*d* at the cathode-side corner of its upper depression. The vanes according to the various embodiments of the present invention are somewhat different from one another in geometrical configuration, but have the same or similar effect. Thus, each of them is provided with a protrusion at the cathode-side corner of its upper depression, which is used to allow a large-diameter strip ring to be disposed therein, to prevent thermions from flowing along a roundabout path.

Although in the above-described embodiments the protrusions 602*a*, 602*b*, 602*c* and 602*d* have been described as an extension of the vanes and thus, made of the same material as the vanes, the protrusions may be made of materials having high conductivity, such as solder.

As described in detail above, the present invention provides a magnetron equipped with a plurality of vanes, which is capable of preventing thermions from flowing along roundabout paths. Therefore, the magnetron of the present invention reduces the difference between the velocities of thermions and equalizes the velocities of thermions, thereby reducing unwanted noise and improving the efficiency of the magnetron.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A magnetron for microwave ovens, comprising:

a positive polar cylinder;

a cathode; and a plurality of vanes to constitute a positive polar section along with the positive polar cylinder, each of the vanes being provided with a first depression to allow a large-diameter strip ring to be disposed therein, and a second depression to allow a small-diameter strip ring to be disposed therein, wherein the vane is provided at a cathode-side corner of the first depression with a thermion travel passage to allow thermions to smoothly flow without hindrance of the first depression.

2. The magnetron according to claim 1, wherein the thermion travel passage is formed by a protrusion formed to fill the cathode-side corner of the first depression.

3. The magnetron according to claim 2, wherein the protrusion has a rectangular shape.

4. The magnetron according to claim 2, wherein the protrusion has a shape of a right-triangle with a concave hypotenuse.

5. The magnetron according to claim 2, wherein the protrusion has a quarter-circular shape.

6. The magnetron according to claim 2, wherein the protrusion has a right-triangular shape.

7. The magnetron according to claim 1, wherein the vanes are made of a solder material.

8. The magnetron according to claim 1, wherein each vane is provided with at least one rectangular protrusion.

9. The magnetron according to claim 1, wherein each vane is provided with at least one rectangular protrusion formed at a top and bottom of the vane.

10. The magnetron according to claim 1, wherein a rectangular protrusion is provided at the first depression to allow thermions to smoothly flow without hindrance of the first depression, thereby reducing an occurrence of noise in the magnetron.

11. The magnetron according to claim 10, wherein the rectangular protrusion is formed at the cathode-side corner to form the thermion travel passage, thereby keeping the thermions from taking a path around the vane.

12. The magnetron according to claim 1, wherein the thermions travel from one of the vanes to another vane with similar velocities so that a frequency generated in the magnetron is stabilized.

13. A magnetron for microwave ovens, comprising:

a positive polar cylinder;

a cathode; and a plurality of vanes to constitute a positive polar section along with the positive polar cylinder, wherein rectangular protrusions are provided at depressions of the vanes to form a thermion travel passage, thereby allowing thermions to smoothly flow from one of the vanes to another vane.

* * * * *